US006202580B1

(12) United States Patent
Samilo

(10) Patent No.: US 6,202,580 B1
(45) Date of Patent: Mar. 20, 2001

(54) TUFTING APPARATUS WITH YARN PULLBACK MECHANISM FOR PRODUCING PATTERNED TUFTED GOODS

(75) Inventor: John Stanley Samilo, Ringgold, GA (US)

(73) Assignee: Tapistron International, Inc., Ringgold, GA (US)

( * ) Notice: Subject to any disclaimer, the term of this patent is extended or adjusted under 35 U.S.C. 154(b) by 0 days.

(21) Appl. No.: 09/305,587

(22) Filed: May 5, 1999

(51) Int. Cl.[7] ..... D05C 15/18; D05C 15/26

(52) U.S. Cl. ..... 112/80.73

(58) Field of Search ..... 112/80.73, 80.7, 112/80.16, 80.23, 80.01, 80.32, 80.05, 80.08

(56) References Cited

U.S. PATENT DOCUMENTS

| | | | | |
|---|---|---|---|---|
| 3,263,630 | * | 8/1966 | Freeman | 112/80.16 X |
| 3,937,157 | | 2/1976 | Spanel et al. | 112/79 |
| 4,154,176 | | 5/1979 | Spanel et al. | 112/79 |
| 4,549,496 | | 10/1985 | Kile | 112/79.5 |
| 4,991,523 | | 2/1991 | Ingram | 112/80.05 |
| 5,080,028 | | 1/1992 | Ingram | 112/80.08 |
| 5,158,027 | | 10/1992 | Ingram | 112/80.08 |
| 5,165,352 | | 11/1992 | Ingram | 112/80.08 |
| 5,182,997 | | 2/1993 | Bardsley | 112/80.73 |
| 5,205,233 | | 4/1993 | Ingram | 112/80.16 |
| 5,267,520 | | 12/1993 | Ingram | 112/410 |
| 5,588,383 | | 12/1996 | Davis et al. | 112/80.16 |
| 5,738,030 | * | 4/1998 | Ok | 112/80.23 X |

* cited by examiner

*Primary Examiner*—Peter Nerbun
(74) *Attorney, Agent, or Firm*—Sutherland, Asbill & Brennan

(57) ABSTRACT

Apparatus for feeding yarn from a yam supply to a reciprocating needle of a multi-color pattern carpet tufting apparatus comprises a yarn pullback mechanism mechanically linked to a yarn feeder such that when the yarn feeder moves out of engagement with a driven roller, the yarn pullback mechanism draws the yarn back from the reciprocating needle. When the yarn feeder moves back into engagement with the driven roller, the yarn pullback mechanism shortens the path between the yarn feeder and the reciprocating needle.

20 Claims, 3 Drawing Sheets

TUFTING APPARATUS WITH YARN PULLBACK MECHANISM FOR PRODUCING PATTERNED TUFTED GOODS

TECHNICAL FIELD

This invention relates generally to tufting apparatus for producing patterned textile goods such as carpet, upholstery, and the like, and more particularly to tufting apparatus for producing tufted goods having a multicolor pattern by selectively feeding different yarns to a row of reciprocating hollow needles which implant the yarns into a transversely shifting backing material. More particularly, this invention relates to a yarn feeding mechanism for use with such a tufting apparatus.

BACKGROUND OF THE INVENTION

U.S. Pat. No. 4,549,496 to Kile discloses a tufting apparatus for producing patterned tufted goods using yarns of different colors. This apparatus is capable of selectively implanting yarns of different colors into a backing to produce a tufted product having a predetermined multicolored pattern. The patent apparatus employs multiple heads spaced across the width of a backing material. Each head comprises a hollow needle for penetrating the backing and implanting yarn tufts in the backing by reciprocating the head and feeding yarn through the needle pneumatically. This device uses a system of gears and rollers to select the desired yarn for implantation into the backing for each penetration by the needle. The multiple heads are stepped in synchronism across the backing for a distance corresponding to the spacing between the heads in order to implant a transverse row of yarn tufts. This process is repeated as the backing is advanced to complete the product. A computer controls the selection of yarn implanted by each needle for each penetration of the backing in order to reproduce the desired pattern in the finished goods.

The apparatus disclosed in the Kile patent and its method of operation have been subsequently modified. Such modifications are disclosed in U.S. Pat. Nos. 4,991,523; 5,080,028; 5,165,352; 5,158,027; 5,205,233; and 5,267,520, all to Ingram., and U.S. Pat. No. 5,588,383 to Davis et al. These subsequent patents disclose an apparatus in which the backing is shifted transversely relative to the reciprocating needles while the backing advances through the apparatus. Thus, rather than the multiple heads which carry the hollow needles being moved across the backing, the subsequent patents disclose an apparatus wherein the backing rather than the heads is shifted transversely. In addition, the device disclosed in the Ingram patents comprises a plurality of hollow needles carried on a widthwise extending member. As the yarn is implanted by the reciprocating needles, the backing is shifted in the transverse direction by an amount corresponding to the spacing between adjacent needles in order to implant a transverse row of tufts. A knife blade is associated with each needle and positioned on the opposite of the backing for cutting the yarn at the lower position of the needle.

The apparatus disclosed in the Ingram patents further includes a mechanism for supplying continuous lengths of the different yarns to the needles comprising a system of gears. More specifically, this yarn supply mechanism includes a main rotatable gear shaft tied to and driven by the main drive shaft that reciprocates the needles. A plurality of small gears extending along the length of the main gear shaft are selectively engagable with the main gear shaft to feed the desired yarns to the needles. The individual gears for feeding the yarns are selectively shifted in and out of meshing cooperation with the main gear shaft by air solenoids. Once the yarn is fed by the gear system, the yarn is drawn to and out of the needle by pressurized air from a manifold mounted to the reciprocating needle mounting bar.

U.S. Pat. No. 5,080,028 discloses a mechanical system for retracting yarns from the needles when other yarns are desired to be implanted. The retraction mechanism includes a reciprocating plunger disposed between two yarn guides. The reciprocating plunger pulls the yarn to be retracted out of the needle and an independent pneumatic mechanism, such as an air solenoid, drives the reciprocating plunger. The reciprocating plunger operates in unison with the pneumatic mechanism which feeds the yarn to the needles.

Although the tufting apparatus disclosed in the Kile and Ingram patents performs well, there is a need for a tufting apparatus for producing patterned textile goods with increased throughput and increased reliability.

SUMMARY OF THE INVENTION

This invention satisfies the foregoing need by providing an apparatus for feeding a yarn from a yarn supply to a reciprocating needle comprising a yarn pullback mechanism which is disposed intermediate a yarn feeder and a reciprocating needle and is mechanically linked to the yarn feeder. More particularly, the yarn feeding apparatus of this invention comprises a driven roller, a yarn feeder disposed for selectively moving into peripheral engagement with the driven roller, and alternatively, moving out of peripheral engagement with the driven roller, an actuator for moving the yarn feeder into and out of peripheral engagement with the driven roller so that when the yarn feeder is in peripheral engagement with the driven roller, the driven roller drives the yarn feeder and causes the yarn feeder to feed the yarn in a path from the yarn feeder to the reciprocating needle, and a yarn pullback mechanism. The yarn pullback mechanism is mechanically linked to the yarn feeder such that when the actuator moves the yarn feeder out of engagement with the driven roller, the yarn pullback mechanism lengthens the path between the yarn feeder and the reciprocating needle and draws the yarn back from the reciprocating needle, and when the actuator moves the yarn feeder into engagement with the driven roller, the yarn pullback mechanism shortens the path between the yarn feeder and the reciprocating needle.

Because the yarn feeding apparatus of the present invention includes a yarn pullback mechanism mechanically driven by a driven roller which also drives the yarn feeder, the yarn pullback mechanism does not require an independent pneumatic mechanism, such as an air solenoid, for power. The mechanical yarn pullpack apparatus of this invention can be made thinner than a pneumatic cylinder and consequently, with this invention, more yarn feed devices can be arranged in a tufting apparatus in less space. This allows spacing of the reciprocable needles of the tufting apparatus more closely together and increases the throughput of the tufting apparatus. Also, because the yarn pullback mechanism of this invention is mechanically linked to the yarn feed drive roller, the tufting apparatus of this invention tufts more accurately than a tufting apparatus having a pneumatically driven yarn pullback mechanism. In addition, because the yarn pullback mechanism of this invention is not pneumatic, the overall air supply requirements for the tufting apparatus is less than that for a tufting apparatus with a pneumatically driven yarn pullback apparatus.

Desirably, the yarn pullback mechanism comprises a yarn pullback member having a passageway through which the yarn passes. More particularly, the yarn pullback member is pivotally disposed, the yarn feeder is pivotally disposed, and the yarn pullback member and the yarn feeder are pivotally connected such that the actuator pivots the yarn feeder into and out of peripheral engagement with the driven roller, and, when the actuator pivots the yarn feeder out of engagement with the driven roller, the yarn pullback member pivots and moves the yarn passageway so as to lengthen the path between the yarn feeder and the reciprocating needle and draw the yarn back from the reciprocating needle, and when the actuator pivots the yarn feeder into engagement with the driven roller, the yarn pullback member returns the passageway so as to shorten the path between the yarn feeder and the reciprocating needle. According to a particular embodiment of this invention, the yarn pullback member comprises a leg which is pivotally disposed proximate one end and a foot extending from another end of the leg so that the yarn pullback member has an L-shape. The yarn passageway is disposed in the foot of the yarn pullback member.

Still more particularly, this invention can further comprise a yarn guide disposed intermediate the yarn feeder and the yarn pullback mechanism for guiding the yarn along the path so that the yarn pullback mechanism is movable relative to the yarn guide. The yarn guide comprises a block having a passageway for receiving and guiding the yarn.

A suitable yarn feeder comprises a movable member and a pair of feed rollers rotatably mounted to the movable member. The feed rollers are peripherally engaged with one another so as to form a nip between the pair of feed rollers for receiving the yarn. One of the pair of feed rollers is disposed for peripheral engagement with the driven roller so that when the one of the pair of feed rollers is engaged with the driven roller, the feed rollers feed the yarn through the nip and along the path. The pair of feed rollers can have meshing gear teeth and the drive roller can have gear teeth for meshing with teeth of one of the pair of feed rollers. Desirably, the pair of feed rollers are capable of holding the yarn when the yarn pullback mechanism draws the yarn back from the reciprocating needle.

A suitable actuator comprises a reciprocable rod connected to one end of the movable yarn feeder member. According to a particular embodiment, the pair of feed rollers are mounted proximate an opposite end of the movable yarn feeder member and the movable yarn feeder member is pivotally disposed intermediate the one end of the movable yarn feeder member and the pair of feed rollers.

This invention also encompasses an apparatus for producing patterned tufted fabric comprising the yarn feeder of this invention described above. This tufting apparatus comprises a tufting frame, a yarn applicator comprising a reciprocable needle for penetrating a backing at a stationary yarn applying region and implanting a yarn therein, a backing transport system mounted to the tufting frame for moving the backing past the stationary yarn applying region and moving the backing transversely relative to the stationary yarn applying region so that the yarn applicator implants the yarn in a transverse row upon selective successive penetrations by said needle, and the yarn feed mechanism of this invention.

Accordingly, an object of the present invention is to provide an improved apparatus for producing patterned tufted goods.

Another object of the present invention is to provide an apparatus for producing, with increased reliability, patterned tufted goods.

Another object of the present invention is to provide an apparatus and method for producing patterned tufted goods at an increased throughput.

Other objects, features and advantages of the present invention will become apparent from the following detailed description, drawings, and claims.

DETAILED DESCRIPTION OF DRAWINGS

The tufting apparatus shown in FIG. 1 includes a number of subsystems which will be identified briefly below and then described in more detail thereafter. First, the structure of the apparatus 10 will be described in detail followed by a detailed description of the operation of the tufting apparatus. Although the tufting apparatus is disclosed in detail hereinafter, some suitable subsystems of the tufting apparatus are disclosed in detail in U.S. Pat. Nos. 4,991,523; 5,080,028; 5,165,352; 5,158,027; 5,205,233; and 5,267,520, all to Ingrain., and U.S. Pat. No. 5,588,383 to Davis et al., the disclosures of which U.S. Patents are hereby expressly incorporated herein by reference in their entirety.

Structure of the Tufting Apparatus

Figure 1:
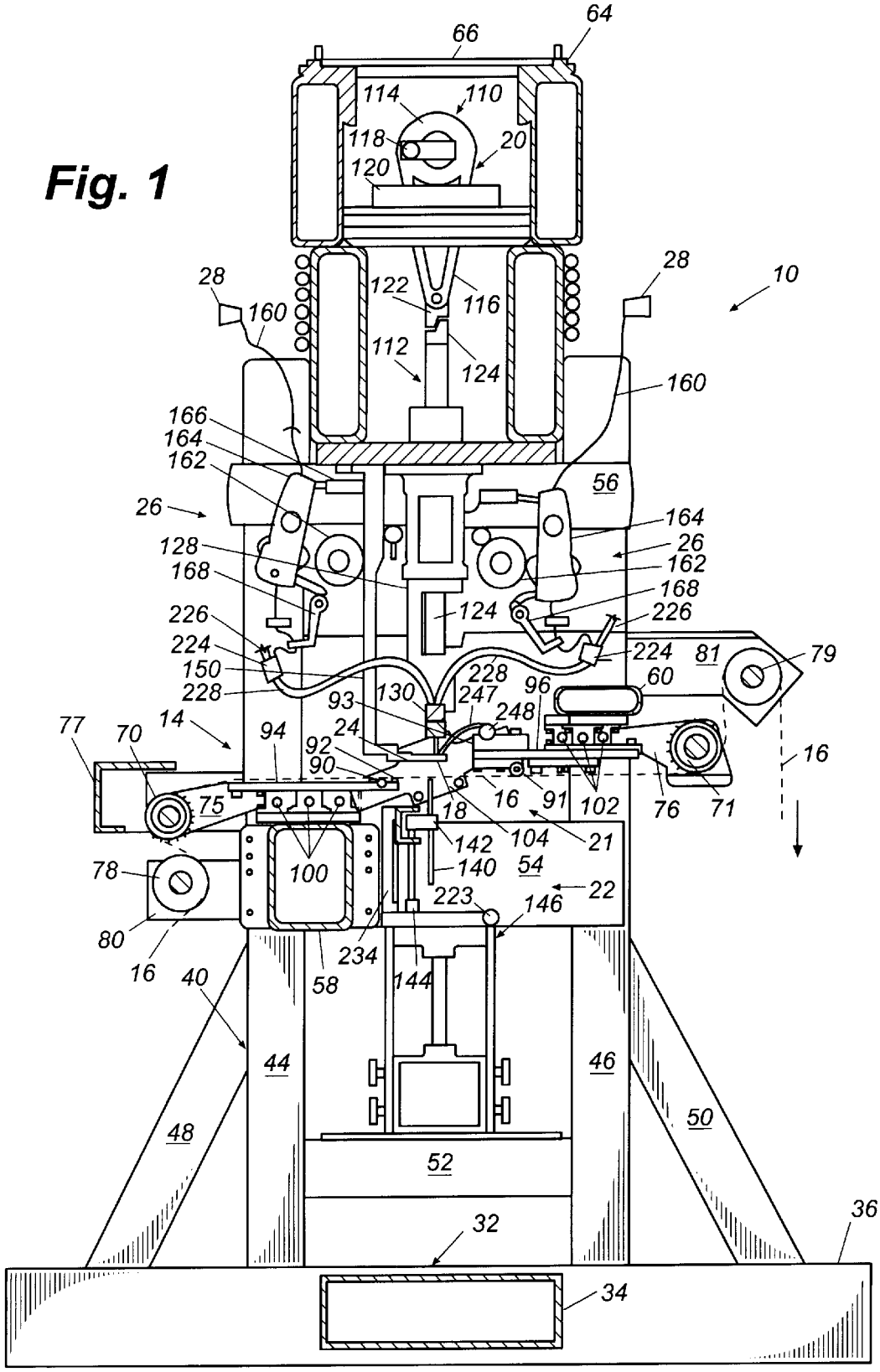
FIG. 1 is a partial sectional elevation view of a tufting apparatus made in accordance with an embodiment of the present invention.

Generally described, the tufting apparatus 10, which is best shown in FIG. 1 comprises a tufting frame 12 supporting a backing transport system 14 for directing a backing 16 through the tufting apparatus, a row of needles 18 mounted to a needle drive system 20 for implanting tufts of yarn in the backing at a yam applying region 21, a yarn cutting system 22 for cutting the yarn as it is implanted, presser feet 24, a yarn feed mechanism 26 for supplying continuous lengths of yarn from a yarn supply, such as a creel (not shown) to the needles, and a control system (not shown) for controlling the operation of the tufting apparatus so as to produce a patterned tufted product in accordance with a preselected pattern.

The term "tuft," as used herein, encompasses both cut yarn stitches and loop yarn stitches, and the term "tufting" encompasses both the act of forming a cut yarn stitch and the act of forming a loop yarn stitch.

The length of the tufting apparatus 10, the spacing of the needles 18, and the number of needles in the apparatus can vary considerably depending on the product to be produced and the desired rate of production.

The Frame

The frame 12 of the tufting apparatus 10 is shown in FIG. 1 and comprises a horizontal I-shaped base frame 32 which includes an elongate member 34 extending perpendicularly between end members 36. Vertical end frames 40 extend upwardly from the end members 36. Each of the end frames 40 comprises a pair of spaced vertical members 44 and 46, angled support bars 48 and 50 extending between the vertical members and the respective end members 36. In each of the end frames 40, a cutter system frame support bar 52, a backing frame support bar 54, and an upper frame support bar 56 are spaced from one another and extend between the vertical members 36. A transverse backing support beam 58 extends between the vertical end frames 40 proximate the backing inlet side 59 of the tufting apparatus 10. Another transverse support beam 60 extends between the vertical end frames 40 at the exit side 61 of the tufting apparatus 10. Respective end panels 62 extend between the spaced vertical members 44 and 46 and between the backing frame and upper frame support bars 54 and 56 for supporting various components as described hereinbelow. A plurality of spaced vertical support bars (not shown) extend vertically between the transverse support beam 60 and elongate main drive housing 64. The main drive housing 64 extends between the vertical end frames 40 and is mounted on top of the upper frame support bars 56.

The interior of the main drive housing 64 is accessible through removable access panels 66 on top of the main drive housing.

The Backing Transport System

The backing transport system 14 transports the backing 16 through the tufting apparatus 10 while the reciprocating hollow needles 18 implant tufts of yarn in the backing at the yarn applying region 21. The backing may be in the form of a continuous running web. The backing 16 is moving in the direction of the arrow in FIG. 1 and the area through which the backing passes through the tufting apparatus 10 is the yarn applying region 21.

As shown in FIG. 1, the backing transport system 14 comprises an entry pin roller 70 and an exit pin roller 71 which are driven by respective electric motors (not shown). The motors maintain the backing 16 under tension as the backing passes the reciprocating needles 18. The exit pin roller motor controls the tension of the backing 16 and the entry pin roller motor controls the velocity of the backing. The pin rollers 70 and 71 are mounted to the frame 12 and extend between respective brackets 75 and 76. A guard assembly 77 is mounted to the frame 12 and extends alongside the entry pin roller 70 to shield the entry pin roller. The backing transport system 14 further comprises a pair of guide rollers 78 and 79 which cooperate with the pin rollers 70 and 71, respectively, to guide the backing 16. The guide rollers 78 and 79 are mounted to the frame 12 and extend between respective brackets 80 and 81. The pin roller motors are connected to the pin rollers 70 and 71 with couplings.

A second pair of pin rollers 90 and 91, which have smaller diameters than the entry and exit pin rollers 70 and 71, are located closely adjacent to reciprocating needles 18 on the opposite sides of the backing 16. These additional pin rollers 90 and 91 provide better control of the backing 16 in the area adjacent to where the yarn tufts are implanted. The smaller pin rollers 90 and 91 are carried on respective brackets 92 and 93.

The backing transport system 14 further comprises a pair of bed plates 94 and 96 for supporting the backing 16 as the backing moves through the tufting apparatus 10. One of the bed plates 94 is positioned below the backing 16 and upstream of the reciprocating needles 18 between the reciprocating needles and the entry pin roller 70. The other of the bed plates 96 is positioned above the backing 16 and downstream of the reciprocating needles 18 between the reciprocating needles and the exit pin roller 71. The bed plates 94 and 96 are transversely shiftable relative to the backing advance direction.

Each of the bed plates 94 and 96 are carried on a pair of transversely extending rods 100 and 102 affixed to the frame 12. The bed plates 94 and 96 are connected at each end by respective connecting members 104 and 105. The entry and exit pin rollers 70 and 71 are preferably also carried by the shiftable bed plates 94 and 96, respectively. The connecting members 104 and 105 are connected to respective electric motors (not shown) with respective commercially available ball screw drives. The ball screw drives should be capable of producing very small and precisely controlled transverse movements when rotated by the motors. Specifically, this precision mechanism should enable precisely controlled incremental movements of the order of one-tenth of an inch or less. The motors and the ball screw drives shift the bed plates 94 and 96, as well as the pin rollers 70 and 71, transversely toward the longitudinal direction of advancement of the backing which produces a corresponding transverse shifting movement of the backing 16 so that each needle 18 may insert yarn into the backing at a number of transverse locations. The guide rollers 78 and 79 may also be shifted transversely in substantial correspondence with the pin rollers 70 and 71 by a second, less precise shifting mechanism.

The Needle Drive System

The needles 18 of the needle drive system 20 are reciprocated by adjustable cam assemblies 110 which are coupled to the needles by respective link assemblies 112. The adjustable cam assemblies 110 are shown in FIG. 1 and comprise a circular cam lobe member 114 rotatably supported by bearings within a circular portion of a yoke member 116. The cam lobe members 114 are carried on and driven by a transversely extending rotatable shaft 118 which is offset from the center of each cam lobe member and preferably supported by bearings on a bearing support 120. The link assemblies 112 comprise a coupling link 122 which is pivotally connected to a yoke member 116 and connected to a vertically extending push rod 124. Each vertically extending push rod 124 extends through and is guiding for vertically reciprocal movement by bearings 126 mounted to the bottom of the main drive housing 64.

The lower ends of the push rods 124 are connected to respective mounting blocks 128 which are, in turn, connected to a transversely extending needle mounting bar 130, which is also referred to as a yarn exchanger. The needles 18 are mounted to the mounting bars 130. In FIG. 1, only one needle 18 is illustrated, but it should be understood that a plurality of needles 18 extend along the length of the needle mounting bar 130. Upon rotation of the shaft 118, the adjustable cam assemblies 110 rotate to impart a reciprocating movement to the yoke members 116 and, in turn, a similar movement to the needles 18 via the link assemblies 112 to cause the needles to repetitively penetrate and withdraw from the backing 16.

The needle mounting bar 130 is rectangular in cross-section, and for each needle 18, has a central passage (not shown) extending from an inlet at the top of the mounting bar to a funnel and a plurality of yarn passages (not shown) surrounding each central passage and extending from respective inlets in the top of the mounting bar to the funnel. Each funnel extends from an inlet an outlet at the bottom of the mounting bar. This arrangement is illustrated in detail in U.S. Pat. No. 5,165,352 already incorporated herein by reference.

The needles 18 each have a hollow passage extending from an inlet to an outlet at a pointed tip. The structure of the needles is disclosed in more detail in U.S. Pat. No. 4,991,523, the disclosure of which is already expressly disclosed herein by reference. Each needle 18 is disposed such that the inlet of the needle is in communication with the outlet of the respective funnel.

The needle drive system 20 is driven by electric motors (not shown) operatively connected to opposite ends of the main drive shaft 118 and mounted to opposite ends of the main drive housing 64 for rotating the main drive shaft. For high product throughput, the main drive motors should rotate the main drive shaft 118 at speeds up to about 1000 rpm.

Each rotation of the main drive shaft 118 causes the needles 18 to penetrate and then withdraw from the backing 16. In other words, each rotation of the main drive shaft 118 causes one needle reciprocation cycle, also referred to as a tufting cycle, which includes a downstroke and an upstroke of the needles 18.

The Yarn Cutting System

As shown in FIG. 1, the yarn cutting system 22 is positioned below the backing transport system 14 and comprises a plurality of knife blades 140, one positioned below each of the needles 18 for cutting the yarn implanted into the backing 16 by the needle at the downstroke of each tufting cycle. The knife blades 140 are arranged to cooperate with the needles 18 by sliding over the respective angled tips of the needles 18 in a shearing-like action to cut the yarn that is ejected from the needles. The yarn cutting system 22 further comprises a blade holder 142, a mechanism 144 for reciprocating the knife blade 140, and a frame 146 for supporting the knife blade, blade holder, and reciprocating mechanism.

The structure of the yarn cutting system 22 is disclosed in more detail in U.S. Pat. No. 5,588,383, the disclosure of which is already expressly disclosed herein by reference.

The Presser Feet

To prevent the needles 18 from raising the backing 16 when the needles are removed from the backing during the upstroke of the needle drive system 20, a plurality of presser feet 24 are disposed adjacent the needles transversely across the tufting apparatus 10 and slightly above the backing. The presser feet 24 are connected to an elongated rail member 150, shown in FIG. 1, with means such as screws. The rail member 150 is connected to the underside of the main drive housing 64 with arms 152 to fix the presser feet 24 to the tufting apparatus frame 12.

Each of the presser feet 24 extend below the needles 18 and have a plurality of bores corresponding to each needle and through which the respective needles may reciprocate freely. Air conduits 154 communicate with each of the needle bores. Pressurized air is blown through the conduits 154 by corresponding tubes 155 connected to a pressurized air pipe 156.

Pressurized air is directed through the conduits 154 and into the needle bores as the needles 18 are withdrawn from the backing 16. This air forces the severed limb of yarn, which is the limb forming the last backstitch and which is no longer connected to the needle, down into the opening in the backing before the needle makes a subsequent opening. This eliminates the excess yarn on the rear of the backing and precludes the yarn from forming a backstitch raised above the surface of the backing material. Each air conduit 154 is desirably disposed at an angle of about 45° relative to the axis of the respective needle 18. The presser feet 154 are similar to those disclosed in U.S. Pat. No. 5,158,027, the disclosure of which is already expressly incorporated herein by reference.

The Yarn Supply System

The tufting apparatus 10 supplies a plurality of different yarns to each needle 18 of the tufting apparatus. The yarns are desirably of a different color so that the tufting apparatus 10 can be used to make multicolor patterned tufted goods such as carpet. The tufting apparatus 10 has a plurality of needles spaced apart. The particular number of needles depends on the product to be produced and the level of throughput desired. The tufting apparatus 10 is capable of selecting, for any given needle 18, on any given needle reciprocation cycle, one of the plurality of different yarns and delivering the desired length of that yarn to the respective needle. In addition, the tufting apparatus is capable of simultaneously withdrawing one yarn from a needle 18 and inserting another yarn into that needle in the same needle reciprocation cycle.

Yarn is supplied to the tufting apparatus 10 through overhead tubes from a creel (not shown). The creel generally comprises a frame for holding a plurality of yarn spools. The structure and function of such creels is well known to those skilled in the art and is not discussed herein in detail.

The yarn feed mechanism 26 is disposed adjacent the push rod 124 of the yarn cutting system 22 and extends between the vertical end frames 40 of the tufting frame 12 along the inlet and exit sides 59 and 61 of the tufting apparatus. The yarn feed mechanism 26 on each side of the tufting apparatus 10 are identical to each other, but in reverse image. Each yarn feed mechanism 26 comprises a driven roller 162 extending between end panel 62 of the vertical end frames 40. In addition, each yarn feed mechanism 26 includes a yarn feeder 164 which is driven by the driven roller 162, an actuator 166 pivotally connected to the yarn feeder for pivoting the yarn feeder, and a yarn pullback mechanism 168 disposed intermediate the yarn feeder and the reciprocating needle 18 and mechanically linked to the yarn feeder. The tufting apparatus 10 includes a plurality of yarn feeders 164, yarn feeder actuators 166, and yarn pullback mechanisms 168 extending along the length of the tufting apparatus adjacent the respective driven rollers 162. The tufting apparatus 10 includes a yarn feeder 164, a yarn feeder actuator 166, and a yarn pullback mechanism 168 for each yarn fed from the yarn supply 28 to the reciprocable tufting needles 18. Accordingly, there are several yarn feeders 164, actuators 166, and yarn pullback mechanisms 168 associated with each tufting needle 18.

Each driven roller 162 is concentrically mounted about a drive shaft 170 which extends the length of the tufting apparatus 10. Each drive shaft 170 is driven by an electric motor (not shown). Each driven roller 162 has gear teeth 172 about its periphery 174. Although the driven roller 162 can be made of any suitably rigid material, each driven roller 162 is desirably made of plastic and is segmented so that only a portion of the driven roller 162 has to be replaced if the driven roller is damaged.

Each yarn feeder 164 comprises a moveable member 176 comprising a pair of plates spaced from one another to form a gap there between. Each moveable member 176 comprises an elongate upper portion or leg 178 and a wider lower portion or foot 180. Each moveable member is pivotally mounted to a journal member 182 extending between the vertical end frames 40 of the tufting frame 12. The journal member 182 extends through a central portion of each moveable member 176.

A pair of geared feed rollers 184 and 186 are pivotally disposed in the foot 180 of each moveable member 176 for feeding yarn 160 from the yarn supply 28 toward the respective tufting needle 18. Each pair of geared feed rollers 184 and 186 have gear teeth 188 and 190 and are arranged so that the teeth of the gear feed rollers are engaged to form a nip 192 between the feed rollers. One of the feed rollers 186 is disposed so as to selectively engage and disengage from the teeth 172 of the respective driven roller 162. Each yarn feeder 164 is disposed for selectively moving into peripheral engagement with the respective driven roller 162, and alternatively, moving out of peripheral engagement with the driven roller. The geared feed rollers 184 and 186 are driven by the respective driven roller 162 when engaged with the driven roller and feed yarn toward the respective tufting needle. The gear feed rollers 184 and 186 do not feed yarn, but rather hold the yarn still, when not engaged with the respective driven roller 162.

Each yarn feeder actuator 166 moves the respective yarn feeder 164 into and out of peripheral engagement with the respective driven roller 162. Suitable actuators include a pneumatic cylinder 196 which is illustrated in FIG. 1, and other reciprocating devices such as an electric solenoid or a hydraulic actuator. The pneumatic actuator 196 includes a rod 198 which extends from the pneumatic cylinder 196 to an arm 200. The arm 200 is pivotally connected to the leg 178 of the moveable member 176 so that the actuator can pivot the moveable member about the journal member 182.

Each yarn pullback mechanism 168 is disposed intermediate the respective yarn feeder 164 and the respective reciprocating needle 18. Each yarn pullback mechanism 168 is mechanically linked to the respective yarn feeder 164 such that when the respective actuator 166 moves the yarn feeder out of engagement with the respective driven roller 162, the yarn pullback mechanism lengthens the path between the yarn feeder and the reciprocating needle and draws the yarn 160 back from the reciprocating needle. When the actuator 166 moves the respective yarn feeder 164 into engagement with the respective driven roller 162, the yarn pullback mechanism 168 shortens the path between the respective yarn feeder and the respective reciprocating needle.

Each yarn pullback mechanism 168 includes an L-shaped yarn pullback member 202 comprising a leg 204 extending from one end 206, which is pivotally connected to a rod extending between the vertical in-frames 40 of the tufting frame 12, and a foot 208 which extends from another end of the leg 204 to a distal end 210. The foot 208 of the yarn pullback member 202 includes a passageway to 12 for receiving the yarn 160 as the yarn is feed from the yarn feeder 164. The yarn pullback mechanism 168 also includes an arm 214 which pivotally connects the one end 206 of the yarn pullback member leg 204 to the foot 180 of the respective yarn feeder moveable member 176. The arm 214 is pivotally connected to both the yarn pullback member leg 204 and the yarn feeder moveable member 176. The yarn pullback mechanism 168 is arranged so that the yarn pullback member 202 pivots and rocks the foot 208 back and forth and in sync with the pivoting action of the yarn feeder 164 driven by the respective actuator 166.

Desirably, a yarn guide bar 220 is disposed intermediate the foot 180 of each moveable member 176 and the respective yarn pullback member 202 along the length of the tufting apparatus 10. The yarn guide bar 220 has a passageway 222 adjacent each yarn feeder 164 for receiving the yarn 160 as the yarn passes from the yarn feeder to the passageway in the respective member foot 208.

A stationary manifold bar 224 extends between the vertical end frames 40 of the tufting frame 12 and receives the yarn 160 from each of the yarn feeders 164 along the length of tufting apparatus. The manifold bar 224 has a plurality of passageways through which the yarns 160 pass. These passageways (not shown) lead the yarns to respective flexible yarn delivery tubes 228 which extend from the manifold bar 224 to respective yarn passageways in the needle mounting bar 130. In addition, the manifold bar 224 includes a plurality of respective pressurized air conduits 226 for receiving pressurized air and directing it through the yarn passageways and the manifold bar and flexible yarn delivery tubes 228 to force the yarns 160 through the respective yarn delivery tubes, through the passageways in the needle mounting bar and through the hollow needles 18.

The Control System

The control system of the tufting apparatus is a programmable computer which generally receives instructions from an operator for making a particular product such as a patterned carpet and controls the various subsystems of the tufting apparatus, including the backing transport system 14, the needle drive system 20, the yarn cutting system 22, and the yarn feed mechanisms 26, in accordance with the operator's instructions to make the desired product. A computer programmer of ordinary skill in the art can obtain or prepare the appropriate software to carry out the respective functions of the control system.

Desirably, patterns such as multicolored patterns for carpet are scanned using a conventional multicolor pattern scanning device, translated into a pattern file, and downloaded onto a floppy disk or the hard drive of the computer. The operator can also input instructions for the timing of the tufting operation.

Operation of the Tufting Apparatus

Once the tufting apparatus 10 is properly set up, the tufting apparatus can produce, in one pass, a tufted multicolored patterned carpet. For example, the tufting apparatus 10 can be set up to deliver six different yarns to each needle, but also could be set up to produce carpet having a pattern with more or less than six colors. In addition, the tufting apparatus 10 can produce a patterned carpet having some cut tufts and some loop tufts. The cut and loop tufts can be arranged to form a pattern themselves.

To set up the tufting apparatus 10, the computer is programmed with the appropriate pattern and timing data, the air pressures for the pneumatic systems and the presser foot are set to levels appropriate for the types of yarns being used, the backing 16 is fed into the backing transport system 14, and the yarns are mounted on the creel and fed through overhead tubes, the yarn feed mechanisms 26, and the yarn delivery tubes 228 to the needle drive system 20.

The computer is programmed with the stitch gauge of the pattern being used so that the backing advance motors, the backing shifting motors and the main drive motors cooperate to reproduce the desired pattern in the tufted product. For example, if the needles 18 in the tufting apparatus 10 are spaced 1" apart, if the gauge, which is the spacing between the adjacent tufts, is 10, then there are ten tufts per inch along a transverse row of tufts. Accordingly, the backing shifting motors must shift ten times per inch to produce the transverse movement of the backing 16. To produce a tufted product without visible interfaces between stitches made by adjacent needles, the backing advance must move constantly while the backing shifting motors shift incrementally back and forth during tufting by the needles 18. This actually produces a chevron pattern of tufts which, in a finished tufted product, is not visible on the face of the product. The method for producing such a chevron pattern is disclosed in detail in U.S. Pat. No. 5,205,233, the disclosure of which is incorporated herein in its entirety.

The tufting operation is begun by the operator by sending a start signal to the computer. The backing transport system 14, the needle drive system 20, the yarn cutting system 22, and the yarn feed mechanism 26 then begin simultaneous operation to produce carpet having the pattern being implemented by the computer. Each full rotation of the main drive shaft 118 is a cycle of the tufting apparatus 10. Through the adjustable cam assemblies 110 and the link assemblies 112, the needles 18 are reciprocated by the rotation of the main drive shaft 118. For every rotation of the main drive shaft 118, the needles 18 reciprocate through a full cycle which includes a downstroke and upstroke. During each reciprocation cycle of the needle drive system 20, the needles 18 can implant a yarn tuft into the backing 16. As the backing advance motors advance the backing 16 and the backing shifting motors move the backing transversely to the direction of advancement of the backing, the reciprocating needles 18 penetrate the backing and implant yarn in the backing successively along transverse rows.

During each cycle of the tufting apparatus 10, yarns are fed to the needles 18 by the yarn feeders 164. The yarn feeders can feed a yarn to each needle 18 during each stroke so that a yarn is tufted by each needle at each penetration of the backing 16 by the needles. In accordance with data sent by the computer to tufting apparatus 10, the yarn feed mechanisms 26 either feed yarn, retract yarn, or hold yarn in accordance with the pattern being implemented by the computer. During each cycle of the tufting apparatus, one yarn feeder 164 can be feeding yarn, while a yarn pullback mechanism 168 is retracting the yarn previously fed. The yarn pullback mechanisms 168 associated with the same needle are holding yarn.

Figure 2:
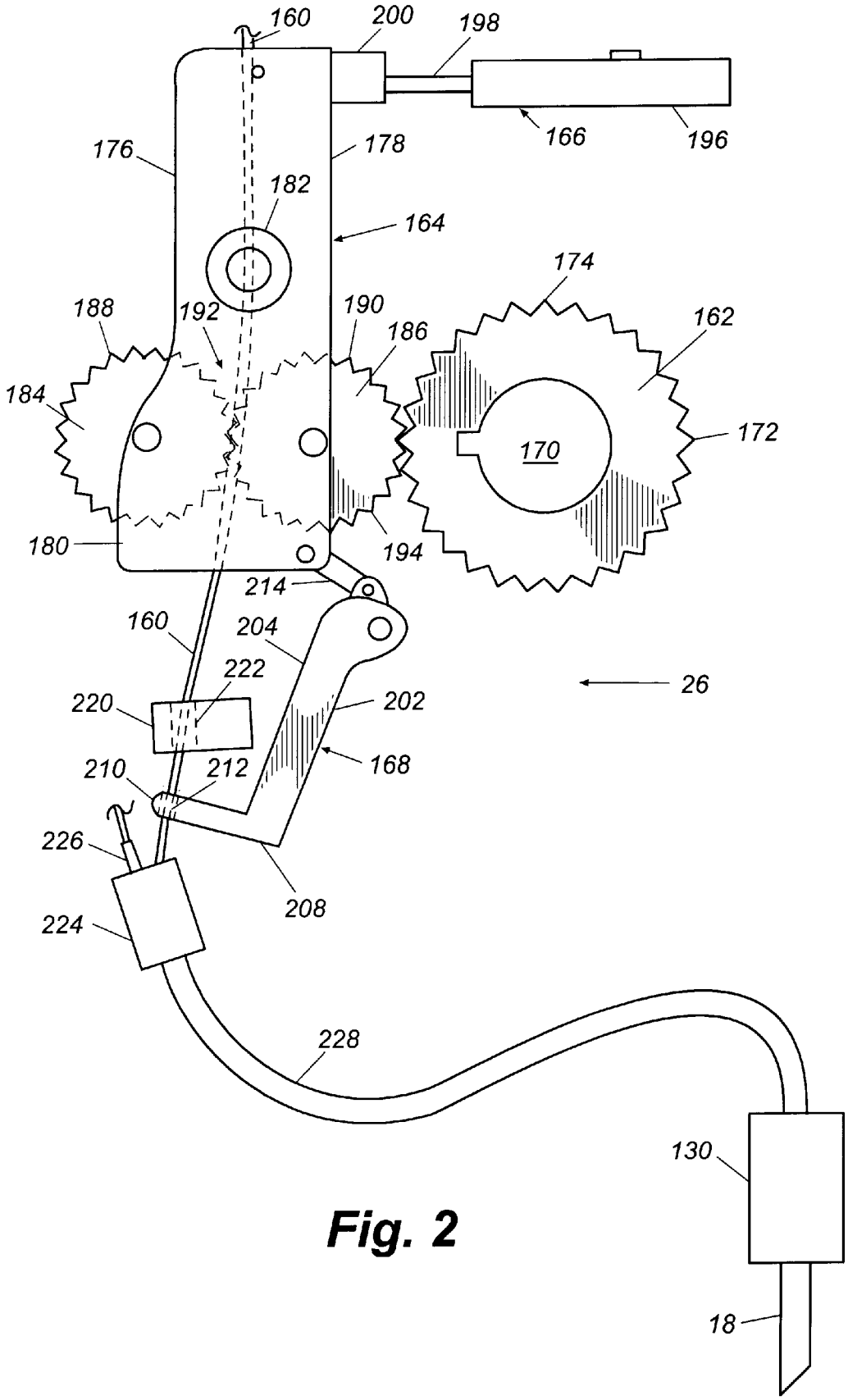
FIG. 2 is a partial plan view of a yarn feed mechanism which forms part of the tufting apparatus shown in FIG. 1. In this view, the yarn feed mechanism is in a configuration for feeding yarn to a needle of the tufting apparatus.

As best shown in FIG. 2, each yarn 160 is feed by a respective yarn feeder 164 toward the yarn manifold 224. The pair of feed rollers 184 and 186 and the moveable member 176 of the yarn feeder 164 feed the yarn 160 through the nip 192 between the feed rollers. When it is time for a particular yarn 160 to be fed, the actuator 166 for the respective yarn feeder 164 pivots the moveable member 176 of the yarn feeder so that one of the feed rollers 186 engages the respective driven roller 162. The driven roller 162 drives the pair of feed rollers 184 and 186 so that the yarn 160 is pulled from the yarn supply 28, through the nip 192 between the feed rollers and out of the foot of the moveable member 176 toward the adjacent yarn guide bar 220. The yarn passes through the respective passageway 222 and the yarn guide bar 220 and then passes through the passageway 212 in the foot 208 of the respective yarn pullback member 202. From the yarn pullback member 202, the yarn 160 travels through the respective passageway and the manifold bar 224 and is driven by pressurized air from the manifold bar through the respective flexible yarn delivery tube 228 to the needle mounting bar 130. Lastly, the yarn travels from the needle mounting bar 130 through the respective needle 18 and out of the end of the needle whereupon the yarn is sheared by the respective cutting blade 140 of the yarn cutting system 22. The cut yarn forms a tuft in the backing 16.

Figure 3:
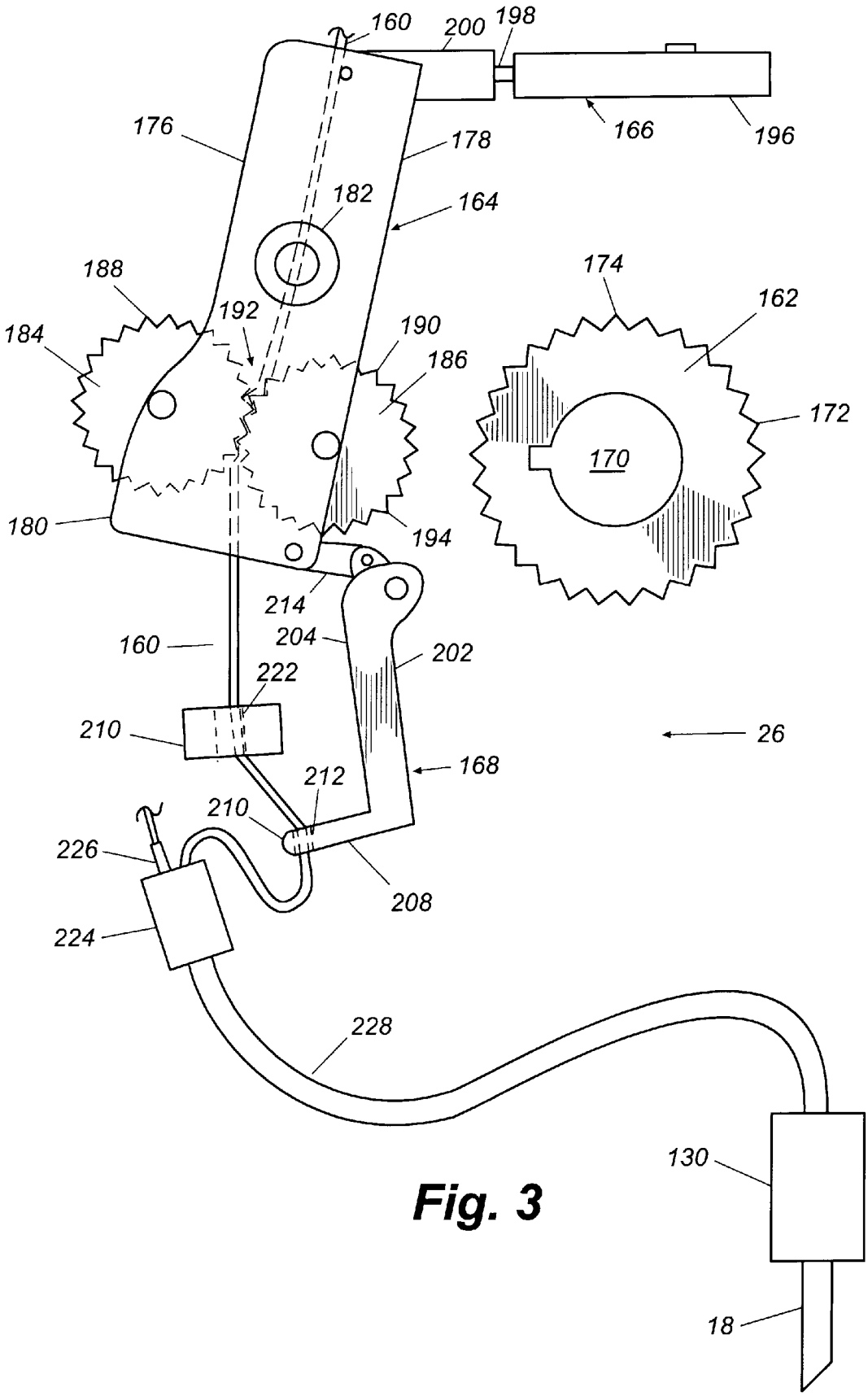
FIG. 3 is another partial plan view of the yarn feed mechanism shown in FIG. 2. In this view, the yarn feed mechanism is in a configuration for pulling yarn back from a needle of the tufting apparatus.

As shown in FIG. 2, while the yarn feeder 164 is feeding yarn 160, the yarn pullback member 202, which is mechanically linked to the moveable member 176 of the yarn feeder 164, is positioned intermediate the yarn guide bar 220 and the manifold bar 224 so that the yarn passes along a reduced path through the foot 208 between the yarn guide bar and the manifold. As shown in FIG. 3, when it is time to retract the yarn 160 from a particular needle 18, the actuator 166 of the respective yarn feeder 164 pulls on the leg 178 of the yarn feeder moveable member 176 and pivots the foot of the moveable member away from the driven roller 162 so that the feed rollers 184 and 186 disengage from the driven roller. Simultaneously, the arm 214 connecting the moveable member 176 of the yarn feeder 164 to the yarn pullback member 202 causes the yarn pullback member to pivot and draw the foot 208 of the yarn pullback member away from the yarn guide bar 220 and the manifold bar 224 thereby lengthening the path traveled by the yarn 160 and withdrawing the yarn back through the needle 18 and the respective flexible yarn delivery tube 228. While the yarn pullback member 202 draws the yarn 160 back through and out of the needle 18, the feed rollers 184 and 186 hold the yarn 160 tightly so that the yarn pullback member does not pull yarn through the feed rollers from the yarn supply 28.

Because the yarn pullback mechanism 168 is mechanically linked to the yarn feeder 164, the yarn feed and yarn pullback is synchronized and the tufting apparatus produces tufts more reliably. In addition, the use of a mechanical yarn pullback mechanism reduces the need for more pressurized air and reduce the operating cost of the tufting apparatus.

It should be understood that the foregoing relates to particular embodiments of the present invention and that numerous changes can be made therein without departing from the scope of the invention as defined by the following claims.

I claim:

1. An apparatus for feeding a yarn from a yarn supply to a reciprocating needle comprising:

a driven roller;

a yarn feeder disposed for selectively moving into peripheral engagement with the driven roller, and alternatively, moving out of peripheral engagement with the driven roller;

an actuator for moving the yarn feeder into and out of peripheral engagement with the driven roller so that when the yarn feeder is in peripheral engagement with the driven roller, the driven roller drives the yarn feeder and causes the yarn feeder to feed the yarn in a path from the yarn feeder to the reciprocating needle; and a yarn pullback mechanism for disposition intermediate the yarn feeder and the reciprocating needle, the yarn pullback mechanism mechanically linked to the yarn feeder such that when the actuator moves the yarn feeder out of engagement with the driven roller, the yarn pullback mechanism lengthens the path between the yarn feeder and the reciprocating needle and draws the yarn back from the reciprocating needle, and when the actuator moves the yarn feeder into engagement with the driven roller, the yarn pullback mechanism shortens the path between the yarn feeder and the reciprocating needle.

2. Apparatus as in claim 1 wherein the yarn pullback mechanism comprises a yarn pullback member having a passageway through which the yarn passes.

3. Apparatus as in claim 2 wherein the yarn pullback member is pivotally disposed, the yarn feeder is pivotally disposed, and the yarn pullback member and the yarn feeder are pivotally connected such that the actuator pivots the yarn feeder into and out of peripheral engagement with the driven roller, and, when the actuator pivots the yarn feeder out of engagement with the driven roller, the yarn pullback member pivots and moves the yarn passageway so as to lengthen the path between the yarn feeder and the reciprocating needle and draw the yarn back from the reciprocating needle, and when the actuator pivots the yarn feeder into engagement with the driven roller, the yarn pullback member returns the passageway so as to shorten the path between the yarn feeder and the reciprocating needle.

4. Apparatus as in claim 3 wherein the yarn pullback member comprises a leg which is pivotally disposed proximate one end and a foot extending from another end of the leg so that the yarn pullback member has an L-shape, the yarn passageway disposed in the foot of the yarn pullback member.

5. Apparatus as in claim 1 further comprising a yarn guide disposed intermediate the yarn feeder and the yarn pullback mechanism for guiding the yarn along the path, the yarn pullback mechanism movable relative to the yarn guide.

6. Apparatus as in claim 5 wherein the yarn guide comprises a block having a passageway for receiving and guiding the yarn.

7. Apparatus as in claim 1 wherein the yarn feeder comprises a movable member and a pair of feed rollers rotatably mounted to the movable member, the feed rollers peripherally engaged with one another so as to form a nip between the pair of feed rollers for receiving the yarn, one of the pair of feed rollers disposed for peripheral engagement with the driven roller so that when the one of the pair of feed rollers is engaged with the driven roller, the feed rollers feed the yarn through the nip and along the path.

8. Apparatus as in claim 7 wherein the pair of feed rollers have meshing gear teeth and the drive roller has gear teeth for meshing with teeth of one of the pair of feed rollers.

9. Apparatus as in claim 8 wherein the pair of feed rollers are capable of holding the yarn when the yarn pullback mechanism draws the yarn back from the reciprocating needle.

10. Apparatus as in claim 9 wherein the actuator comprises a reciprocable rod connected to one end of the movable yarn feeder member, the pair of feed rollers are mounted proximate an opposite end of the movable yarn feeder member, and the movable yarn feeder member is pivotally disposed intermediate the one end of the movable yarn feeder member and the pair of feed rollers.

11. An apparatus for producing patterned tufted fabric comprising:

a tufting frame;

a yarn applicator comprising a reciprocable needle for penetrating a backing at a stationary yarn applying region and implanting a yarn therein;

a backing transport system mounted to the tufting frame for moving the backing past the stationary yarn applying region and moving the backing transversely relative to the stationary yarn applying region so that the yarn applicator implants the yarn in a transverse row upon selective successive penetrations by said needle; and a yarn feed mechanism for feeding the yarn from a yarn supply to the reciprocating needle comprising:

a driven roller;

a yarn feeder disposed for selectively moving into peripheral engagement with the driven roller, and alternatively, moving out of peripheral engagement with the driven roller;

an actuator for moving the yarn feeder into and out of peripheral engagement with the driven roller so that when the yarn feeder is in peripheral engagement with the driven roller, the driven roller drives the yarn feeder and causes the yarn feeder to feed the yarn in a path from the yarn feeder to the reciprocating needle; and a yarn pullback mechanism disposed intermediate the yarn feeder and the reciprocating needle, the yarn pullback mechanism mechanically linked to the yarn feeder such that when the actuator moves the yarn feeder out of engagement with the driven roller, the yarn pullback mechanism lengthens the path between the yarn feeder and the reciprocating needle and draws the yarn back from the reciprocating needle, and when the actuator moves the yarn feeder into engagement with the driven roller, the yarn pullback mechanism shortens the path between the yarn feeder and the reciprocating needle.

12. Apparatus as in claim 11 wherein the yarn pullback mechanism comprises a yarn pullback member having a passageway through which the yarn passes.

13. Apparatus as in claim 12 wherein the yarn pullback member is pivotally disposed, the yarn feeder is pivotally disposed, and the yarn pullback member and the yarn feeder are pivotally connected such that the actuator pivots the yarn feeder into and out of peripheral engagement with the driven roller, and, when the actuator pivots the yarn feeder out of engagement with the driven roller, the yarn pullback member pivots and moves the yarn passageway so as to lengthen the path between the yarn feeder and the reciprocating needle and draw the yarn back from the reciprocating needle, and when the actuator pivots the yarn feeder into engagement with the driven roller, the yarn pullback member returns the passageway so as to shorten the path between the yarn feeder and the reciprocating needle.

14. Apparatus as in claim 13 wherein the yarn pullback member comprises a leg which is pivotally disposed proximate one end and a foot extending from another end of the leg so that the yarn pullback member has an L-shape, the yarn passageway disposed in the foot of the yarn pullback member.

15. Apparatus as in claim 11 further comprising a yarn guide disposed intermediate the yarn feeder and the yarn pullback member for guiding the yarn along the path, the yarn pullback mechanism movable relative to the yarn guide.

16. Apparatus as in claim 11 wherein the yarn feeder comprises a movable member and a pair of feed rollers rotatably mounted to the movable member, the feed rollers peripherally engaged with one another so as to form a nip between the pair of feed rollers for receiving the yarn, one of the pair of feed rollers disposed for peripheral engagement with the driven roller so that when the one of the pair of feed rollers is engaged with the driven roller, the feed rollers feed the yarn through the nip and along the path.

17. Apparatus as in claim 16 wherein the pair of feed rollers have meshing gear teeth and the drive roller has gear teeth for meshing with teeth of one of the pair of feed rollers.

18. Apparatus as in claim 16 wherein the pair of feed rollers are capable of holding the yarn when the yarn pullback mechanism draws the yarn back from the reciprocating needle.

19. Apparatus as in claim 16 wherein the actuator comprises a reciprocable rod connected to one end of the movable yarn feeder member, the pair of feed rollers are mounted proximate an opposite end of the movable yarn feeder member, and the movable yarn feeder member is pivotally disposed intermediate the one end of the movable yarn feeder member and the pair of feed rollers.

20. Apparatus as in claim 11 wherein the reciprocating needle is a hollow needle.

* * * * *